US006343840B1

(12) United States Patent
Chuang

(10) Patent No.: US 6,343,840 B1
(45) Date of Patent: Feb. 5, 2002

(54) HEIGHT ADJUSTMENT MECHANISM FOR CHAIR BACKREST OR ARM

(75) Inventor: Mei-Chin Chuang, Tainan (TW)

(73) Assignee: Yi Chun Enterprise Ltd., Madou Tainan County (TW)

( * ) Notice: Subject to any disclaimer, the term of this patent is extended or adjusted under 35 U.S.C. 154(b) by 4 days.

(21) Appl. No.: 09/860,926

(22) Filed: May 18, 2001

(51) Int. Cl.[7] ..... A47C 7/54
(52) U.S. Cl. ..... 297/411.36; 297/353
(58) Field of Search ..... 297/353, 441.36

(56) References Cited

U.S. PATENT DOCUMENTS

| | | | | | |
|---|---|---|---|---|---|
| 5,597,204 | A | * | 1/1997 | Karaus, Jr. | 297/411.36 X |
| 5,853,223 | A | * | 12/1998 | Ritt et al. | 297/411.36 |
| 5,931,537 | A | * | 8/1999 | Gollin et al. | 297/411.36 |
| 6,139,107 | A | * | 10/2000 | Lee | 297/411.36 |
| 6,209,961 | B1 | * | 4/2001 | Chen | 297/411.36 |

* cited by examiner

*Primary Examiner*—Peter R. Brown
(74) *Attorney, Agent, or Firm*—Alan Kamrath; Rider, Bennett, Egan & Arundel, LLP

(57) ABSTRACT

A height adjustment mechanism for chair backrest or arm comprises a tube-like brace having a transverse elongate groove and transverse apertures; a sliding member in the brace with an upper end secured to backrest or arm; a guide member coupled to a lower end of the sliding member; a hook flexibly coupled to the guide member having an upper bent free end; a first half-cylindrical member in the brace for receiving a portion of the sliding member and the hook, an internal notched member having curved members and a longitudinal channel; a second half-cylindrical member in the brace matingly secured to the first half-cylindrical member, an upper hole, a lower hole, and a spring-depressible detent in the lower hole; and a lock pin inserted through the groove and the upper hole to secure the brace and the second half-cylindrical member together. Backrest or arm may be pushed down to cause the bent end to move through the channel and pulled up to lock in one of the curved members. An adjustment of arm toward left or right is also possible.

4 Claims, 7 Drawing Sheets

HEIGHT ADJUSTMENT MECHANISM FOR CHAIR BACKREST OR ARM

FIELD OF THE INVENTION

The present invention relates to mechanisms for adjusting components of a chair relative to one another, and more particularly to a height adjustment mechanism for chair backrest or arm with improved characteristics.

BACKGROUND OF THE INVENTION

Conventional height adjustment mechanisms for backrest or arm of a chair are strength dependent and require considerable effort on the part of user to achieve positioning. Further, such prior mechanisms are typically complex in constructions, difficult to assemble, trouble-prone, unreliable, and unsightly. Thus, improvement exists.

SUMMARY OF THE INVENTION

It is thus an object of the present invention to provide an adjustment mechanism mounted on a chair for releasably locking one chair component such as backrest or arm in any one of a plurality of positions relative to a seat of the chair, the adjustment mechanism comprising a tube-like brace having one end secured to underside of the seat, a transverse elongate groove, and a plurality of transverse disposed apertures; a sliding member slideable in the brace with an upper end secured to one chair component; a guide member coupled to a lower end of the sliding member having a longitudinal slot; a hook member having a lower end flexibly coupled to the longitudinal slot of the guide member and an upper bent end; a first half-cylindrical member in the brace including an inner space for receiving the sliding member and the hook member, a plurality of alternate recesses and risers on either side, an internal notched member having a plurality of curved members and a longitudinal channel in communication with the curved members; a second half-cylindrical member in the brace including a plurality of alternate recesses and risers matingly snapped to the alternate risers and recesses of the first half-cylindrical member respectively for securing the half-cylindrical members together, two latches in lower and upper openings respectively for frictionally locking the sliding member, an upper hole, a lower hole, and a spring-depressible detent in the lower hole; and a lock pin inserted through the transverse elongate groove and the upper hole to secure the brace and the second half-cylindrical member together; wherein one chair component is operative to push down to cause the bent end to move through the channel and pull up to lock in one of the curved members.

In one aspect of the present invention, one chair component is an arm so that the detent is operative to disengage from one aperture prior to rotating the arm to cause the detent to engage with the other aperture.

The above and other objects, features and advantages of the present invention will become apparent from the following detailed description taken with the accompanying drawings.

DETAILED DESCRIPTION OF THE PREFERRED EMBODIMENTS

Figure 1:
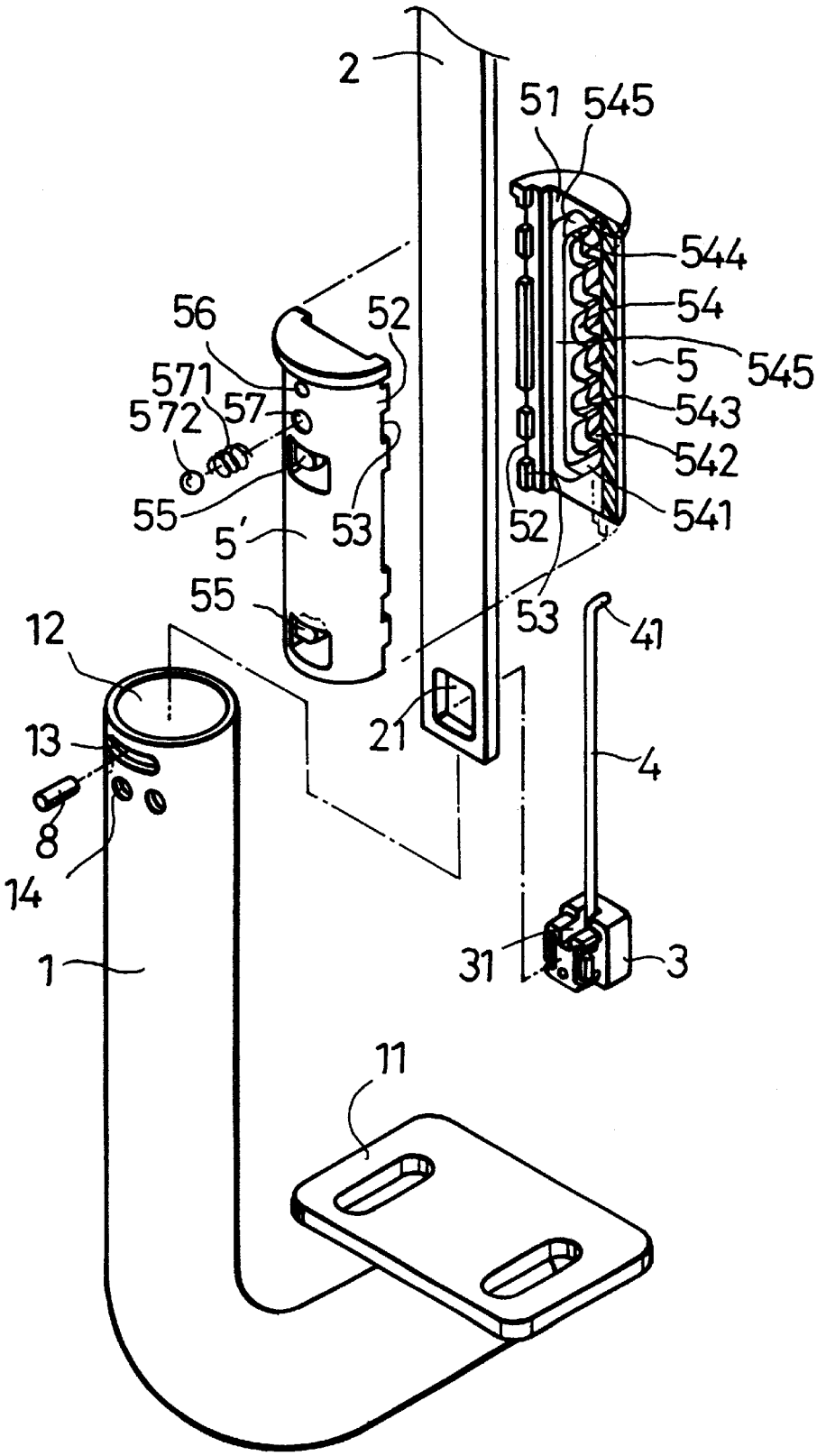
FIG. 1 is an exploded view of a height adjustment mechanism according to the invention mounted on backrest or arm of a chair.

Referring to FIGS. 1 to 6, there is shown a height adjustment mechanism constructed in accordance with the invention mounted on either backrest or arm of chair. The mechanism comprises a tube-like brace or J-bar 1 including a plate 11 on the horizontal section being secured to the underside of chair, a bore 12 through the brace 1, a transverse elongate groove 13 near the top end, and a plurality of transverse disposed apertures 14 below the groove 13; a sliding member 2 slideable in the bore 12 having a lower opening 21 and an upper end secured to a component of backrest or arm (e.g., joint 71 of backrest 7 in FIG. 3); a guide member 3 snapped in the lower opening 21 of sliding member 2 having a longitudinal slot 31; a hook member 4 having a lower end flexibly coupled to the longitudinal slot 31 (i.e., small transverse vibration permitted) and an upper bent end 41; a first half-cylindrical member 5 provided in the bore 12 including an inner space 51 for receiving sliding member 2 and hook member 4, a plurality of alternate recesses 52 and risers 53 on either side, an internal notched member 54 having a plurality of curved members each including a first curve 541, a stop 542, and a second curve 543, a topmost projection 544, and a longitudinal channel 545; a second half-cylindrical member 5' provided in the bore 12 including a plurality of alternate recesses 52 and risers 53 matingly snapped to the alternate risers 53 and recesses 52 of the first half-cylindrical member 5 respectively for securing half-cylindrical members 5 and 5' together, two latches 55 in lower and upper openings respectively for frictionally locking sliding member 2, an upper hole 56, a lower hole 57, a spring 571 received in the lower hole 57, and a steel ball 572 having a diameter larger than that of the lower hole 57 so that only a small portion of the steel ball 572 is projected from the lower hole 57 while other remaining portions are concealed and biased by the spring 571; and a lock pin 8 inserted through the transverse elongate groove 13 and the upper hole 56 to secure the brace 1 and second half-cylindrical member 5' together.

Figure 2:
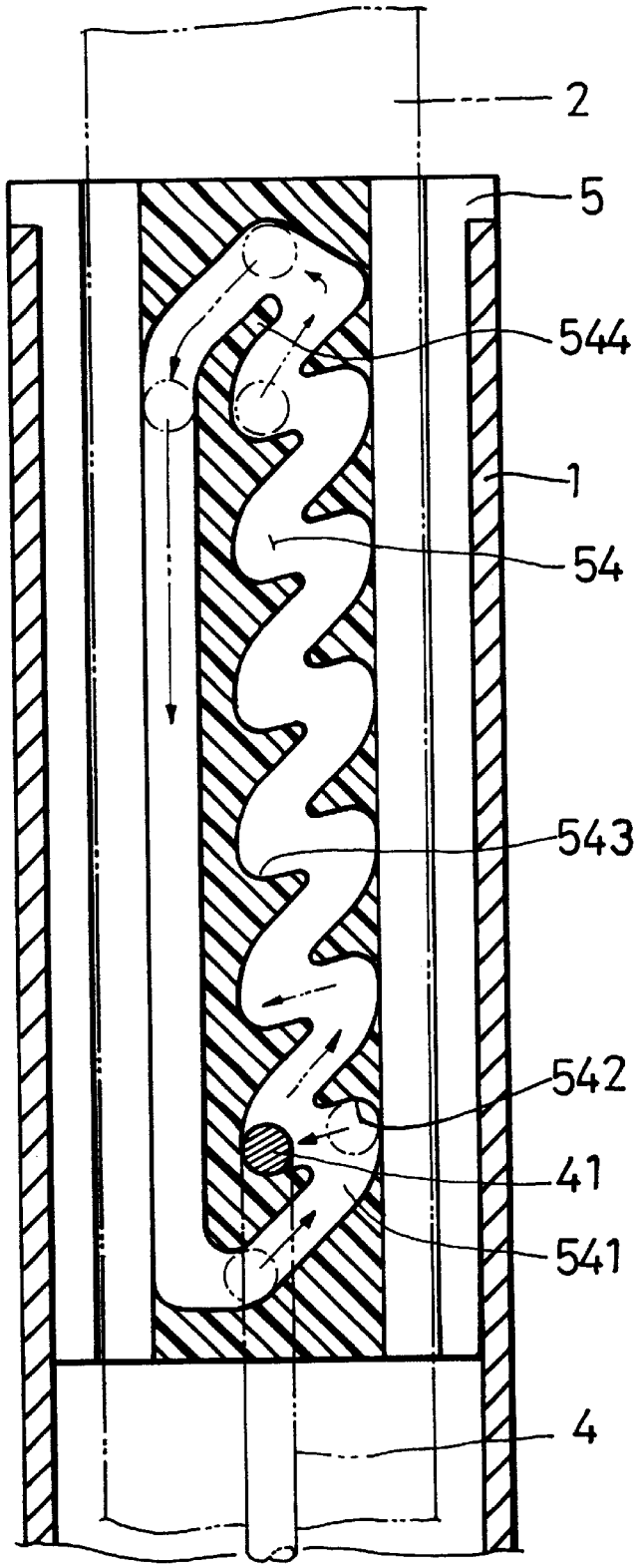
FIG. 2 is sectional view showing hook member of FIG. 1 slideable in a notched member of a half-cylindrical member.
Figure 3:
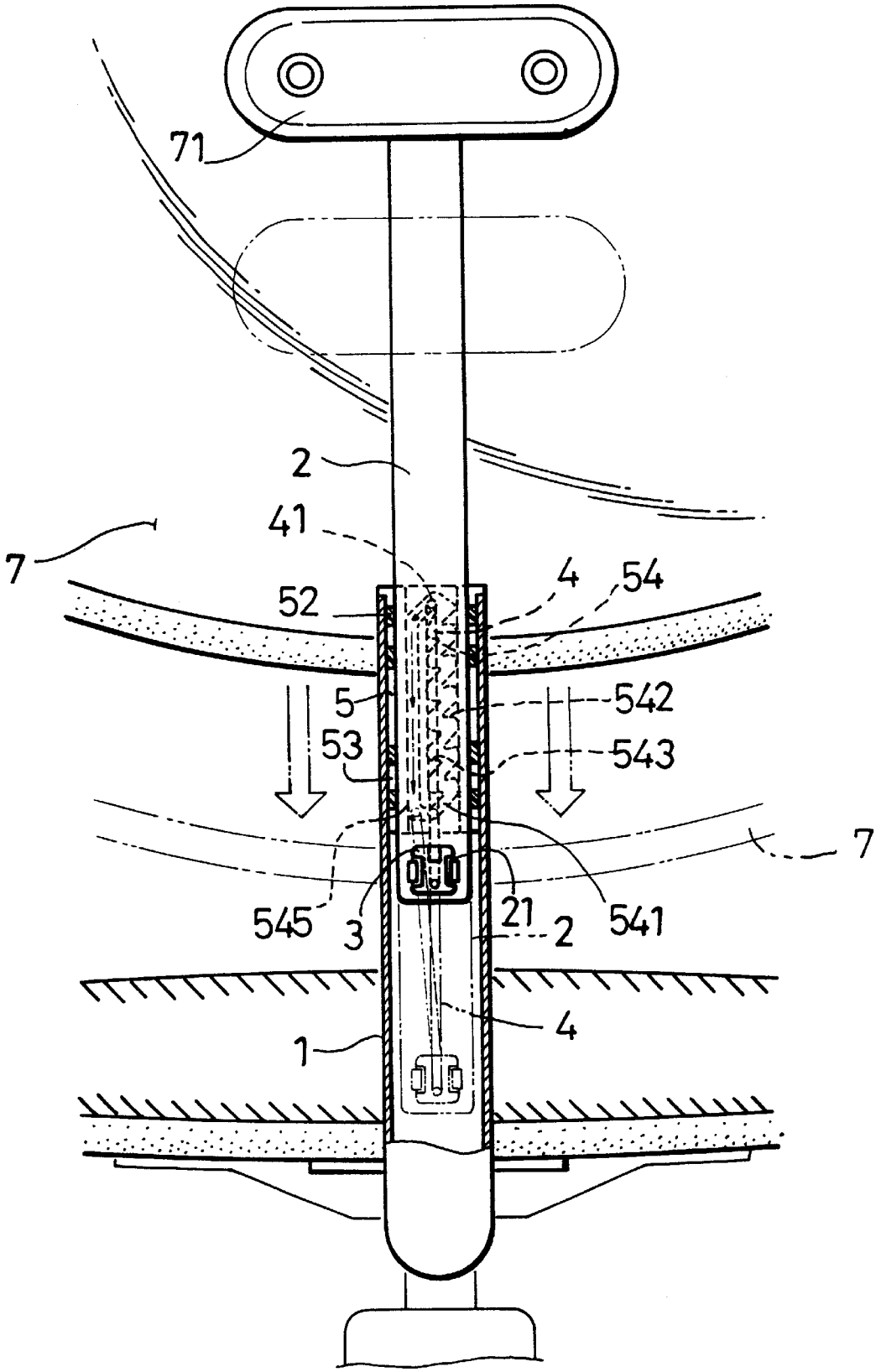
FIG. 3 is a rear plan view in part section showing backrest has been adjusted to a maximum height.
Figure 4:
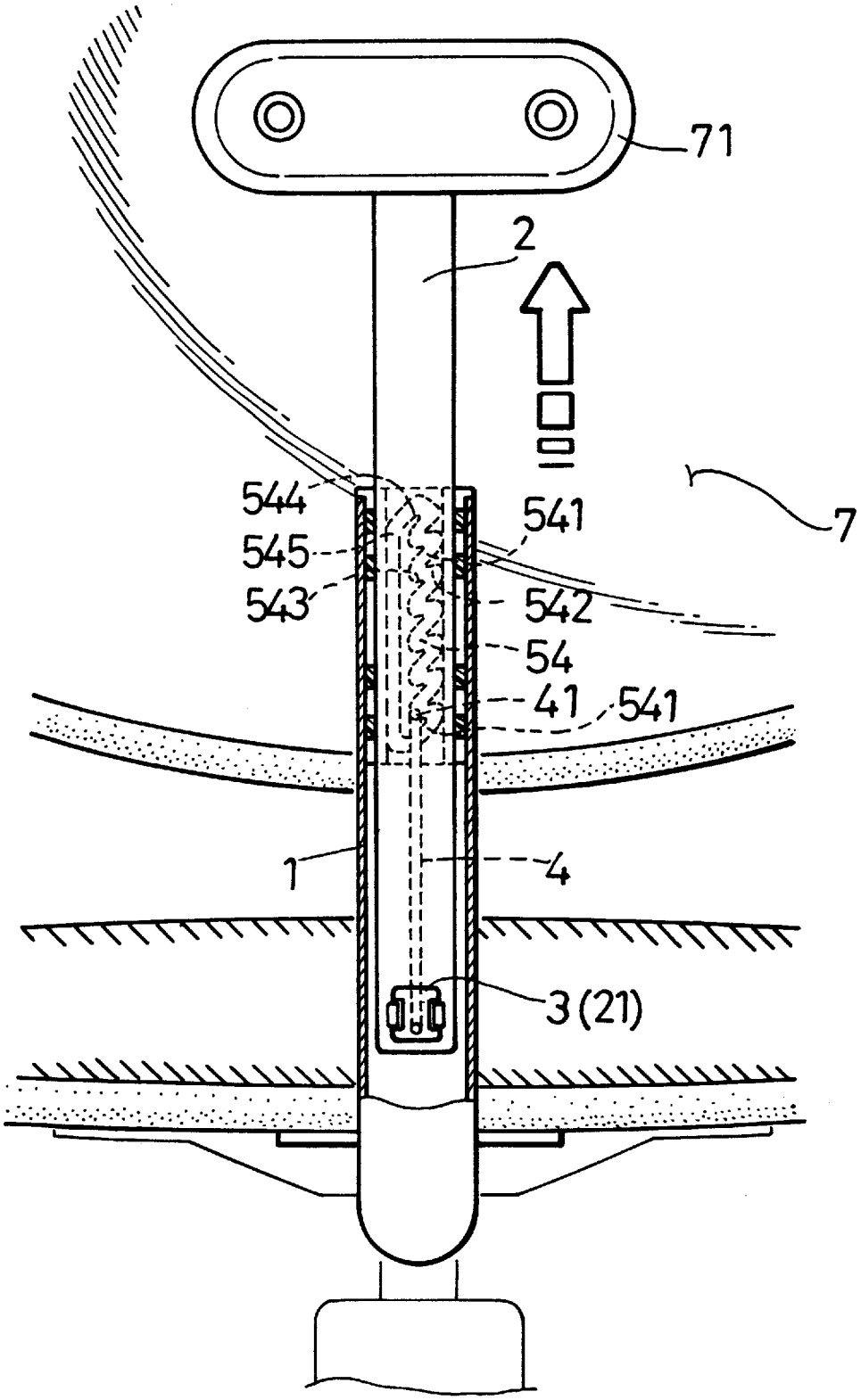
FIG. 4 is view similar to FIG. 3 where backrest has been adjusted to a minimum height.
Figure 5:
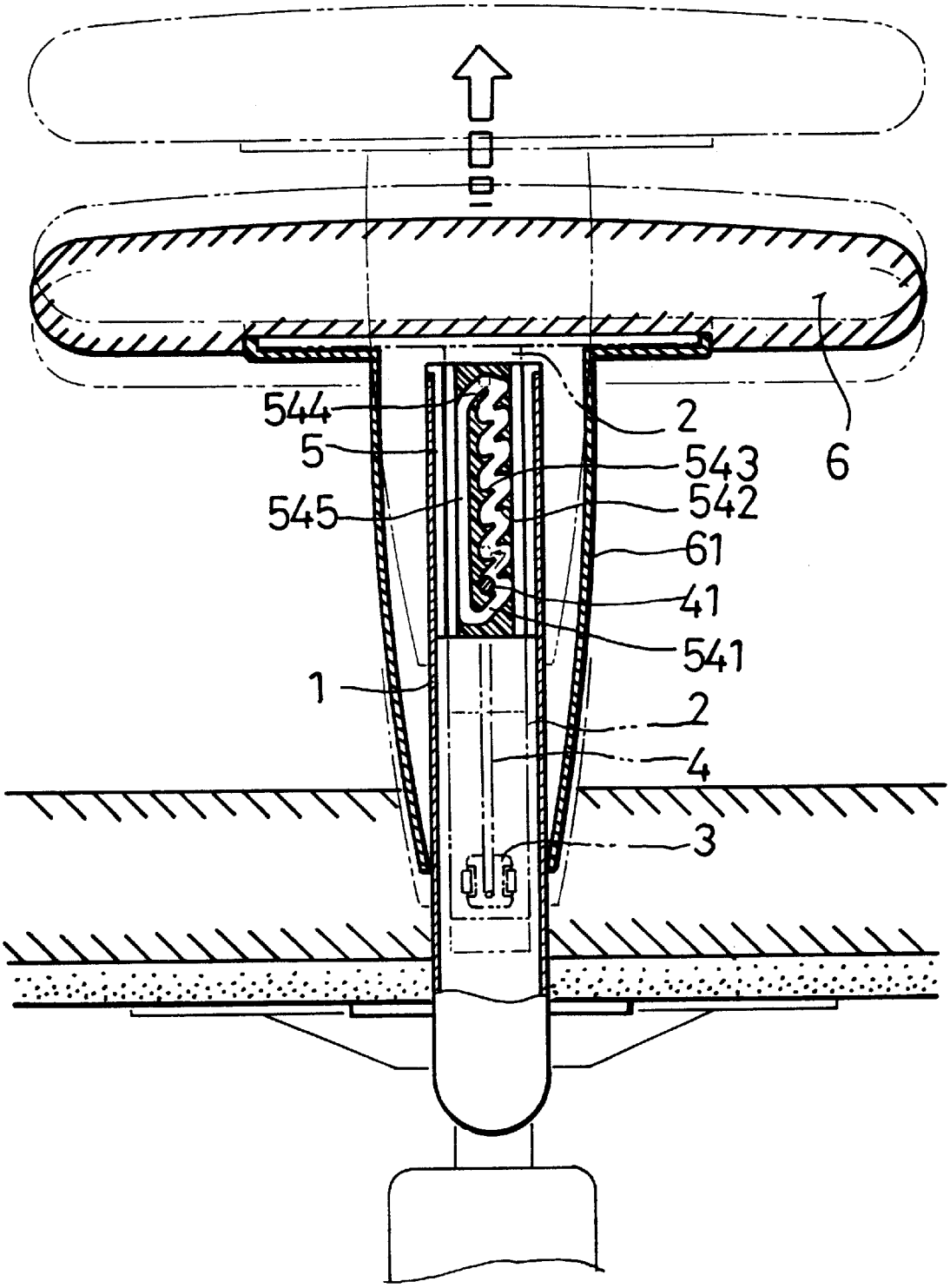
FIG. 5 is a sectional view the FIG. 1 height adjustment mechanism mounted on an arm.
Figure 6:
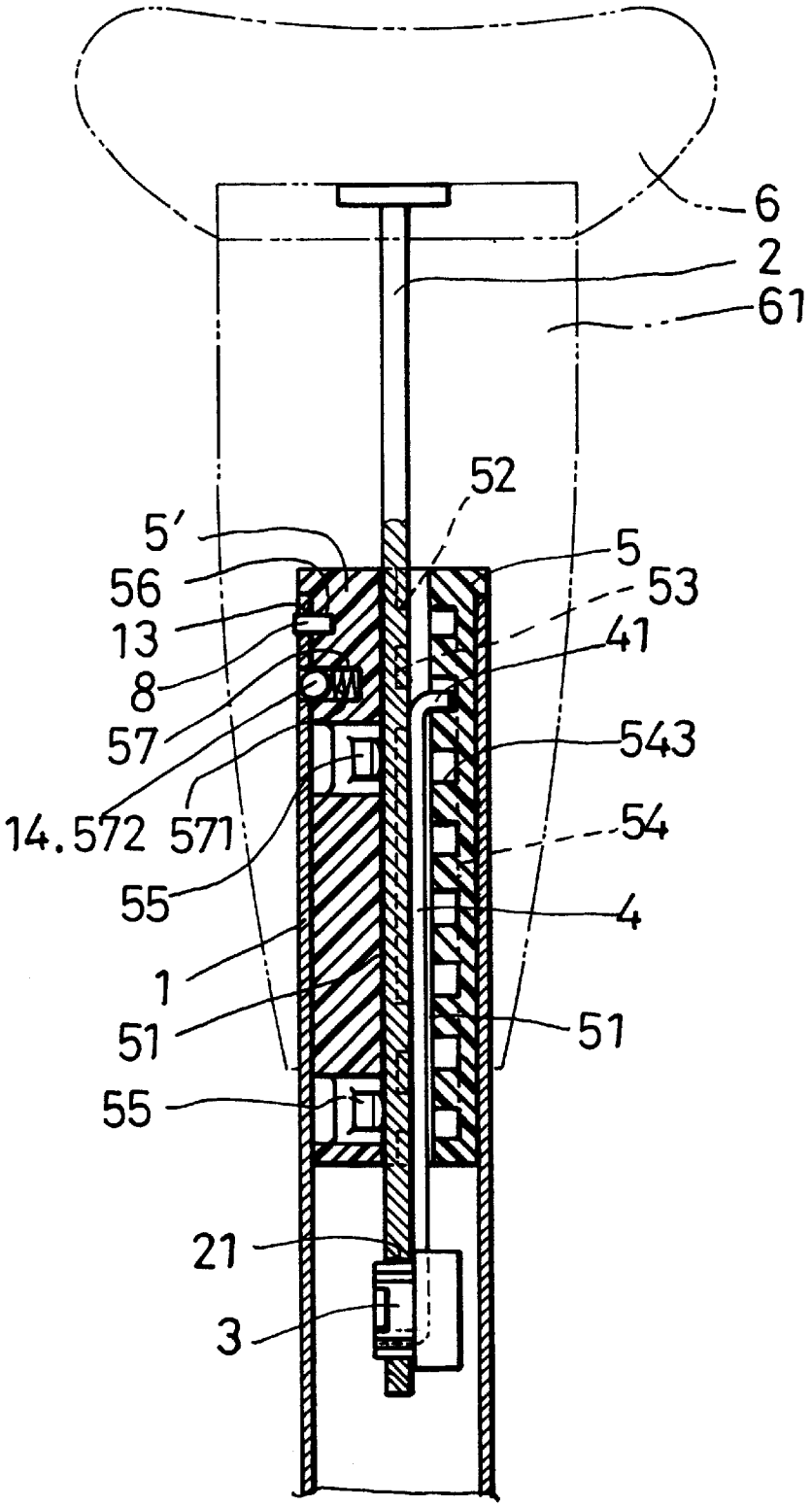
FIG. 6 is another sectional view of FIG. 5 showing the assembled mechanism.

Bent end 41 of hook member 4 is moveable around a loop formed by the curved members and channel 545 of notched member 54 as indicated by arrow in FIG. 2. Hence, in height adjustment, for example bent end 41 in a topmost position (FIG. 3), user may push down backrest 7 to cause bent end 41 to slide down along channel 545 to a lowest position (FIG. 4). If the lowest height of backrest 7 is not desired, user may then pull up backrest 7 to cause bent end 41 to move up along the curved members of hook member 4 so as to position bent end 41 in any one of stops 542 for obtaining a desired height of backrest 7. Similarly, if the height adjustment mechanism is mounted in an arm 6 the same operation may be performed for adjusting height thereof (FIGS. 5 and 6).

Figure 7:
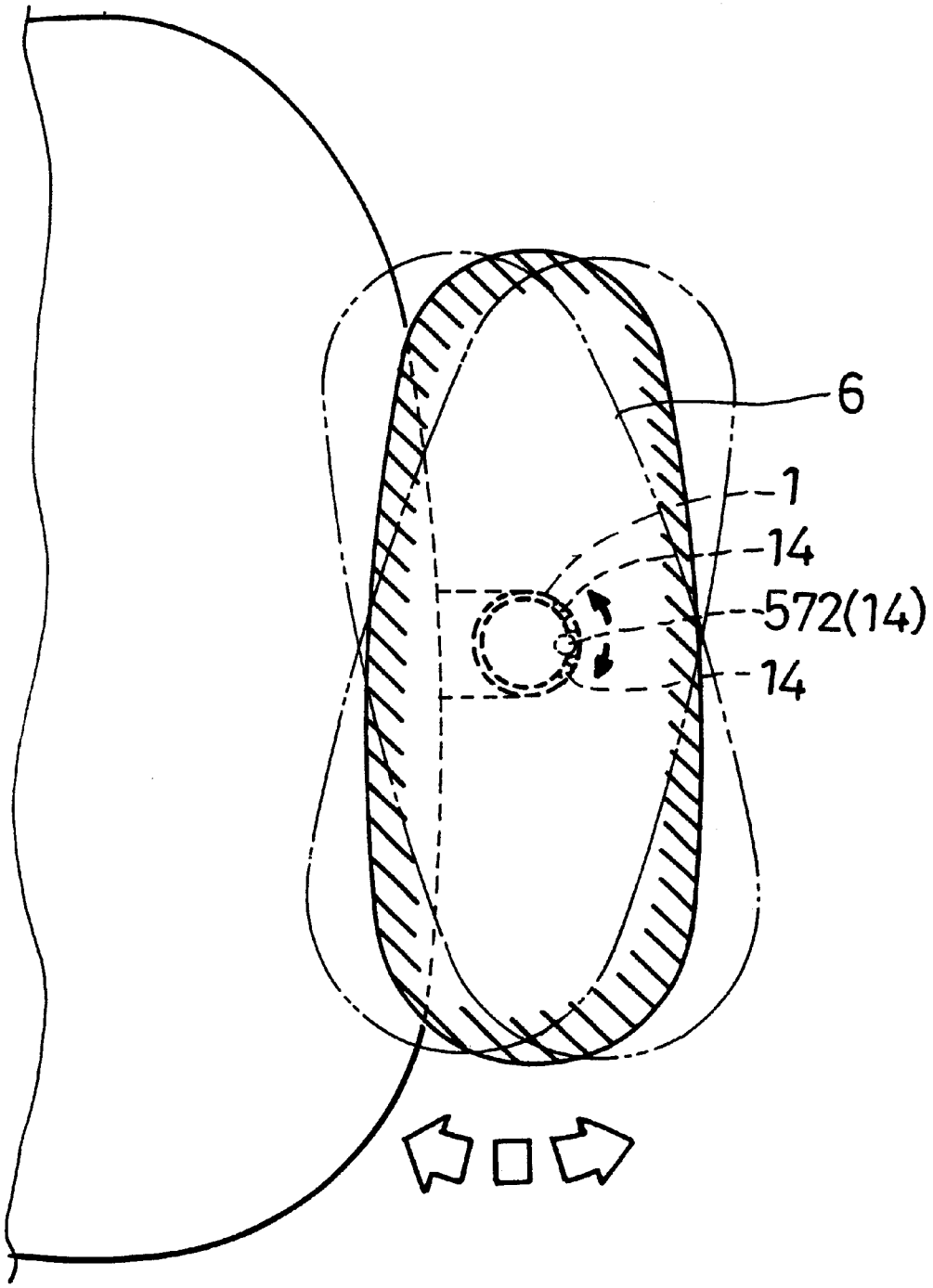
FIG. 7 is top plan view showing the mechanism mounted on arm in an adjustment of arm toward left or right in a horizontal level.

Another feature of the mechanism of the invention is that when the mechanism is mounted on an arm 6 an adjustment of arm 6 toward left or right in a horizontal level is also possible. This may be best illustrated by referring to FIGS. 1 and 7, user may first press the steel ball 572 to disengage it from one aperture 14 and then rotate arm 6 to cause the steel ball 572 to engage with another desired aperture 14.

While the invention has been described by means of specific embodiments, numerous modifications and variations could be made thereto by those skilled in the art without departing from the scope and spirit of the invention set forth in the claims.

What is claimed is:

1. An adjustment mechanism mounted on a chair for releasably locking one chair component in any one of a plurality of positions relative to a seat of said chair, said adjustment mechanism comprising:

a tube-like brace having one end secured to underside of said seat, a transverse elongate groove, and a plurality of transverse disposed apertures;

a sliding member slideable in said brace with an upper end secured to one chair component;

a guide member coupled to a lower end of said sliding member having a longitudinal slot;

a hook member having a lower end flexibly coupled to said longitudinal slot of said guide member and an upper bent end;

a first half-cylindrical member in said brace including an inner space for receiving said sliding member and said hook member, a plurality of alternate recesses and risers on either side, an internal notched member having a plurality of curved members and a longitudinal channel in communication with said curved members;

a second half-cylindrical member in said brace including a plurality of alternate recesses and risers matingly snapped to said alternate risers and recesses of said first half-cylindrical member respectively for securing said half-cylindrical members together, two latches in lower and upper openings respectively for frictionally locking said sliding member, an upper hole, a lower hole, and a spring-depressible detent in said lower hole; and a lock pin inserted through said transverse elongate groove and said upper hole to secure said brace and said second half-cylindrical member together;

wherein one chair component is operative to push down to cause said bent end to move through said channel and pull up to lock in one of said curved members.

2. The adjustment mechanism of claim 1, wherein one chair component is a backrest.

3. The adjustment mechanism of claim 1, wherein one chair component is an arm.

4. The adjustment mechanism of claim 3, wherein said detent is operative to disengage from one aperture prior to rotating said arm to cause said detent to engage with the other aperture.

* * * * *